US006568476B1

(12) United States Patent
Andersen

(10) Patent No.: US 6,568,476 B1
(45) Date of Patent: May 27, 2003

(54) TRIGGERING MECHANISM FOR DISCONNECTING A RISER FROM A RISER CONNECTOR

(75) Inventor: Jan Oddvar Andersen, Randaberg (NO)

(73) Assignee: Smedvig Offshore AS, Stavanger (NO)

( * ) Notice: Subject to any disclaimer, the term of this patent is extended or adjusted under 35 U.S.C. 154(b) by 0 days.

(21) Appl. No.: 10/060,319

(22) Filed: Feb. 1, 2002

(51) Int. Cl.[7] ..... E21B 34/06; E21B 23/04

(52) U.S. Cl. ..... 166/363; 166/364; 166/345; 285/1; 285/922

(58) Field of Search ..... 166/363, 364, 166/345; 285/1, 922

(56) References Cited

U.S. PATENT DOCUMENTS

| | | | | | |
|---|---|---|---|---|---|
| 2,505,245 | A | * | 4/1950 | Hollerith | 137/614.03 |
| 3,383,122 | A | * | 5/1968 | Richardson | 285/1 |
| 3,450,421 | A | * | 6/1969 | Harwell, Jr. | 285/24 |
| 3,489,434 | A | * | 1/1970 | Haley | 285/1 |
| 3,606,244 | A | * | 9/1971 | Nusbaum | 251/149.9 |
| 3,695,633 | A | * | 10/1972 | Hanes | 285/18 |
| 3,729,941 | A | * | 5/1973 | Rochelle | 405/169 |
| 3,746,372 | A | * | 7/1973 | Hynes et al. | 285/95 |
| 3,851,897 | A | * | 12/1974 | Piazza et al. | 285/18 |
| 4,045,054 | A | * | 8/1977 | Arnold | 285/18 |
| 4,489,962 | A | * | 12/1984 | Caumont et al. | 285/263 |
| 4,721,132 | A | | 1/1988 | Houlgrave | |
| 4,911,483 | A | * | 3/1990 | Delamare | 285/268 |
| 5,382,056 | A | | 1/1995 | Milberger | |
| 6,234,252 | B1 | | 5/2001 | Pallini, Jr. et al. | |
| 6,305,720 | B1 | * | 10/2001 | Spiering et al. | 285/18 |

FOREIGN PATENT DOCUMENTS

| | | |
|---|---|---|
| GB | 1282 690 | 7/1972 |

* cited by examiner

*Primary Examiner*—Robert E. Pezzuto
*Assistant Examiner*—Thomas A. Beach
(74) *Attorney, Agent, or Firm*—Birch, Stewart, Kolasch & Birch, LLP

(57) ABSTRACT

A triggering mechanism for a triggering valve (1) of a hydraulic emergency unlock circuit for unlocking hydraulically operated gripping members of a riser connector which connects a lower end of a riser (2) to a wellhead on a sea floor. The triggering mechanism comprises a cam ring (5) secured to a displaceable part (4) of a flex joint for the riser (2), and an actuator ring (8) which by means of hydraulic cylinders are translatory movable towards a stationary part (3) of the flex joint. An angular displacement ($\alpha$) of the riser (2) causes an angular displacement ($\alpha$) of the cam ring (5), which contacts the actuator ring (8) and forces the actuator ring (8) towards the stationary part (3) of the flex joint, causing an activating of a trigger (13) for the triggering valve (1).

7 Claims, 1 Drawing Sheet

TRIGGERING MECHANISM FOR DISCONNECTING A RISER FROM A RISER CONNECTOR

BACKGROUND OF THE INVENTION

The invention relates to a triggering mechanism for a triggering valve of a hydraulic emergency unlock circuit for unlocking hydraulically operated gripping members of a riser connector which connects a lower end of a riser to a wellhead on a sea floor.

Drilling of offshore hydrocarbon wells is performed by a drill string arranged in a riser extending from a wellhead on the sea floor to a drilling vessel. The drilling vessel may be anchored to the sea floor or kept in position by thrusters of a dynamic positioning system. The lower end of the riser is connected to the wellhead by a riser connector, which includes some type of hydraulically operated gripping members, such as fingers which in a locked position clamp a flange of the lower end of the riser.

Connectors which may be used for connecting a riser to a wellhead is disclosed in U.S. Pat. No. 4,721,132, U.S. Pat. No. 5,382,056 and U.S. Pat. No. 6,234,252.

SUMMARY OF THE INVENTION

In order to allow a movement of the drilling vessel, which may be caused by wind, waves and current, the riser is normally connected to the riser connector via a flex joint which allows some angular displacement of the riser. If the angular displacement of the riser exceeds a maximum acceptable angle, dictated by maximum allowable stresses in the wellhead, the riser or the drilling vessel, the riser will be disconnected from the wellhead, which is carried out by a hydraulic circuit which unlock the hydraulically operated gripping members of the riser connector.

The hydraulic circuit which unlocks the hydraulically operated gripping members may fail, and it is therefore preferred to have an emergency unlock circuit for unlocking the gripping members. Further, to ensure a high reliability, the activating of the emergency unlock circuit should be reliable and independent of any external connections or signals.

The object of the invention is thus to provide a triggering mechanism for a triggering valve of a hydraulic emergency unlock circuit for unlocking hydraulically operated gripping members of a riser connector which connects a lower end of a riser to a wellhead on a sea floor, which triggering mechanism shall be reliable, and the triggering shall be independent of any external connections or signals.

The object is achieved by a triggering mechanism according to claim 1.

The inventive triggering mechanism is used together with a riser connector as discussed above. Angular displacement of the riser is allowed by a flex joint comprising a stationary part clamped by the gripping members and an angularly displaceable part secured to the lower end of the riser. The stationary part of the flex joint and the displaceable part of the flex joint are coaxial when the riser is in a non-displaced position.

According to the invention, the triggering mechanism comprises a cam ring which is secured to the displaceable part of the flex joint, and which is coaxial with the displaceable part of the flex joint. Further the triggering mechanism comprises hydraulic cylinders which are secured to the stationary part of the flex joint, which are parallel with an axis of the stationary part of the flex joint, and which are arranged in a circle which is coaxial with the stationary part of the flex joint. The hydraulic cylinders have through-going piston rods, and an actuator ring is mechanically connected to ends of the piston rods which point towards the cam ring. The actuator ring is thus coaxial with the stationary part of the flex joint, and thus the cam ring and the actuator ring are parallel when the stationary part of the flex joint and the displaceable part of the flex joint are coaxial. The actuator ring have a clearance to the cam ring. Pistons divide the hydraulic cylinders in upper and lower chambers, the upper chambers being on the actuator ring side of the pistons, the through-going piston rods ensure equal cross-sectional area in the upper and lower chambers. Further cross-connecting conduits connect upper chambers with lower chambers in oppositely located hydraulic cylinders. A trigger for the triggering valve is located on the stationary part of the flex joint, between the stationary part of the flex joint and the actuator ring.

An angular displacement of the riser will cause an angular displacement of the cam ring. When the angular displacement of the cam ring exceeds a predetermined angle, which may happen in an emergency situation, the cam ring contacts the actuator ring and forces the actuator ring towards the stationary part of the flex joint, which causes movement of the piston rods and the pistons. The movement of the pistons causes hydraulic flow in the cross-connecting conduits, which ensure equal movement of pistons and piston rods in oppositely located hydraulic cylinders. The actuator ring thereby moves translatory, and activates the trigger for the triggering valve, irrespectively of the direction of the angular displacement of the riser.

It is thereby provided a triggering mechanism made by simple mechanical and hydraulic components, which make the mechanism reliable. Further the triggering is caused by a direct and simple mechanical transfer of the angular displacement of the riser, independent of any external connections or signals.

BRIEF DESCRIPTION OF THE DRAWINGS

The invention will now be explained in closer detail with reference to the enclosed drawings, in which.

DESCRIPTION OF THE PREFERRED EMBODIMENTS

Figure 1:
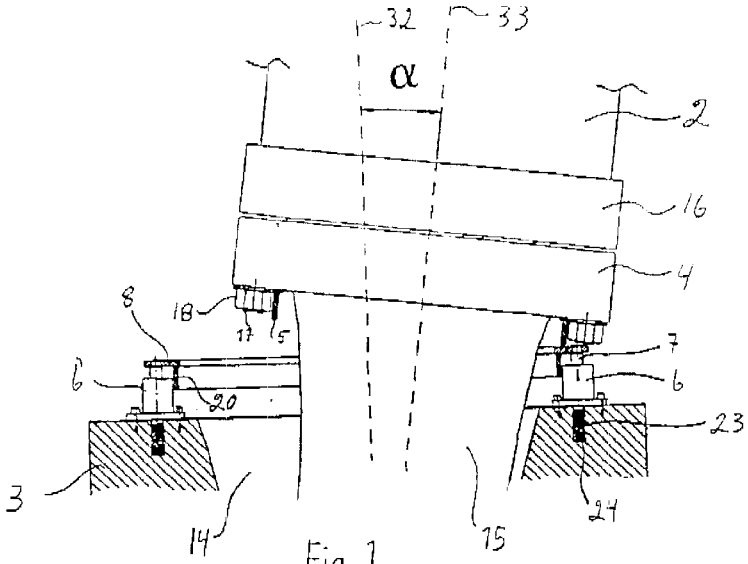
FIG. 1 is a side view of a flex joint and a triggering mechanism according to the invention.

FIG. 1 is a side view of a flex joint which connects a riser to a riser connector. The flex joint comprises a stationary part formed by a hub 3. A lower not illustrated portion of the hub 3 is by means of not illustrated hydraulically operated gripping members clamped in a not illustrated riser connector arranged below the hub 3. The riser connector forms an upper part of a not illustrated wellhead on a sea floor, which wellhead forms an upper part of a not illustrated hydrocarbon well. The gripping members may consist of fingers or dogs which in a locked position exert a clamping force on the lower part of the hub 3, which may have grooves corresponding to the fingers.

The flex joint further comprises a flexible element 14, which may include steel-reinforced rubber. The flexible element 14 holds an angularly displaceable neck 15 which is integral with a flange 4. The flange 4 is by means of bolts 17 and nuts 18 connected to a riser flange 16, which is integral with a riser 2. The neck 15 and the flange 4 thereby constitute an angularly displaceable part of the flex joint.

The stationary part 3 of the flex joint has an axis 32, while the displaceable part 4 of the flex joint has an axis 33. When the displaceable part 4 of the flex joint is in a non-displaced position, the axes 32 and 33 coincide.

The riser 2 extends to a not illustrated drilling vessel, and drilling of the hydrocarbon well is carried out by a drill string extending from the drilling vessel through the riser 2, through not illustrated openings in the flanges 16 and 4, the neck 15 and the flexible element 14, and further down through the riser connector and the wellhead.

Due to wind, waves and current, the drilling vessel may move, which causes an angular displacement of the riser 2, as illustrated in FIG. 1, in which the riser 2 has been displaced by an angle $\alpha$. The angle $\alpha$ will normally be monitored by a sensor (not illustrated). If the angle a exceeds a maximum acceptable angle, which may be caused by harsh weather or a failure in the positioning system for the drilling vessel, the riser will be disconnected from the wellhead. This disconnection is carried out by an automatic or manual activating of a hydraulic circuit which unlock the gripping members of the riser connector.

The hydraulic circuit which unlock the gripping members may fail, in which case the angular displacement a of the riser will increase beyond the maximum acceptable angle. In this case there is an emergency situation, and to handle this situation, there is a hydraulic emergency unlock circuit for unlocking the hydraulically operated gripping members. Preferably, in order to be self-contained, the emergency unlock circuit should be pressurised by hydraulic accumulators located within or close to the wellhead. The invention relates to a triggering mechanism for a triggering valve of the hydraulic emergency unlock circuit. The emergency unlock circuit may be designed in any manner known to a skilled person.

Figure 2:
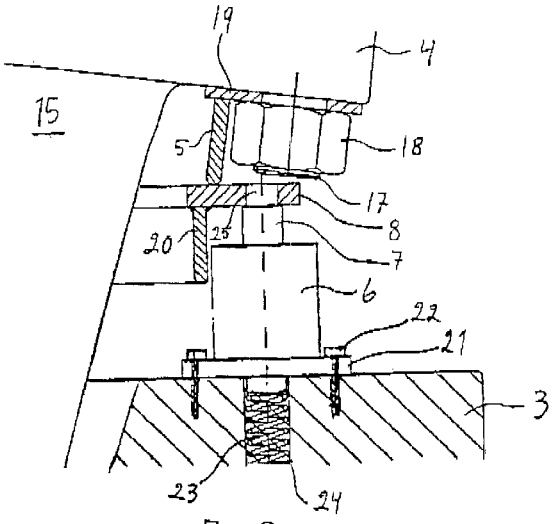
FIG. 2 illustrates the triggering mechanism in closer detail.

FIG. 2 illustrates the triggering mechanism in closer detail. The triggering mechanism comprises a cam ring 5 which is welded to an attachment ring 19 which is bolted to the flange 4 by the bolts 17 and the nuts 18. The cam ring 5 is thereby secured to the displaceable part of the flex joint and is coaxial with the displaceable part of the flex joint.

Hydraulic cylinders 6, 6' are secured to the stationary part of the flex joint, i.e. the hub 3, by bolts 22 extending through flanges 21 of the hydraulic cylinders 6, 6'. The hydraulic cylinders 6, 6' are parallel with the axis 32 of the hub 3, and are arranged in a circle which is coaxial with the hub 3. The hydraulic cylinders are distributed along their circle, and although only two hydraulic cylinders are illustrated in FIG. 1, there are a number of hydraulic cylinders forming the circle.

Figure 3:
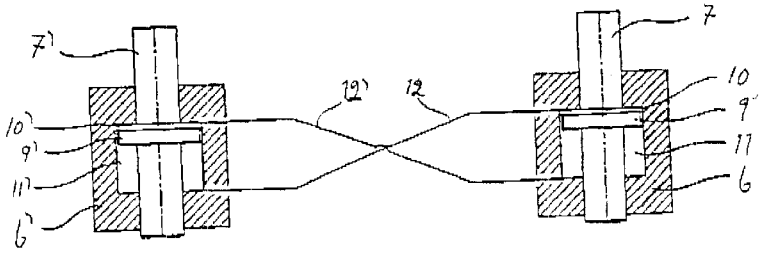
FIG. 3 illustrates two cross-connected hydraulic cylinders forming parts of the inventive mechanism.

FIG. 3 illustrates two hydraulic cylinders 6, 6'. The hydraulic cylinders are provided with through-going piston rods 7, 7'. An actuator ring 8 (not illustrated in FIG. 3) is mechanically connected to ends of the piston rods 7, 7' pointing towards the cam ring 5. This mechanical connection is achieved by pins 25 in the ends of the piston rods, which pins are secured in openings in the actuator ring 8, e.g. by means of welding. A stiffening ring 20 is welded to the actuator ring. The actuator ring 8 is coaxial with the stationary part 3 of the flex joint. When the displaceable part 4 of the flex joint is in the non-displaced position, i.e. $\alpha=0$, the cam ring 5 and the actuator ring 8 are parallel. Further, in the non-displaced position, there is a clearance between the actuator ring 8 and the cam ring 5. As illustrated in FIG. 1 and 2, the lower ends of the piston rods 7, 7' extend into recesses 24 in the hub 3. Springs 23 are located in the recesses, and biases the piston rods 7, 7' with the actuator ring 8 towards the cam ring 5.

Pistons 9, 9' divide the hydraulic cylinders 6, 6' in upper chambers 10, 10' and lower chambers 11, 11', the upper chambers 10, 10' being on the actuator ring 8 side of the pistons 9, 9'. The through-going piston rods 7, 7' ensure equal cross-sectional area in the upper and lower chambers. A cross-connecting conduit 12 connects upper chamber 10 of the right hydraulic cylinder 6 with lower chamber 11' of the left hydraulic cylinder 6', and a cross-connecting conduit 12' connects upper chamber 10' of the left hydraulic cylinder 6' with lower chamber 11 of the right hydraulic cylinder 6. For the sake of simplicity, the cross-connecting conduits are not illustrated in FIGS. 1 and 2.

A downward movement of piston rod 7 in the right hydraulic cylinder 6 (see FIG. 3) causes hydraulic fluid to flow from lower chamber 11 of the right hydraulic cylinder 6, through cross-connecting conduit 12', and into upper chamber 10' of the left hydraulic cylinder 6'. This causes a similar downward movement of piston 9' and piston rod 7' in the left hydraulic cylinder 6', which in turn causes hydraulic fluid to flow from lower hydraulic chamber 11' of the left hydraulic cylinder 6', through cross-connecting conduit 12, and into upper chamber 10 of the right hydraulic cylinder 6. In this way a movement of one of the piston rods causes a similar movement of the other piston rod, and the two hydraulic cylinders 6, 6' thereby form a pair of co-acting hydraulic cylinders.

As illustrated in FIG. 1, the hydraulic cylinders 6 and 6' are oppositely located. As discussed, there are more hydraulic cylinders located in the circle of cylinders. These other hydraulic cylinders also form similar pairs of oppositely located co-acting hydraulic cylinders interconnected by cross-connecting conduits. An external force on the actuator ring 8 towards or away from the hub 3, causing a movement of one or more of the piston rods, thereby causes a similar movement of the other piston rods and an even movement of the actuator ring 8, i.e. the actuator ring moves translatory.

Preferably, to achieve a convenient design, the hydraulic cylinders have a number of six and are equally spaced along their circle, forming three pairs, each pair consisting of two oppositely located cross-connected hydraulic cylinders.

Figure 4:
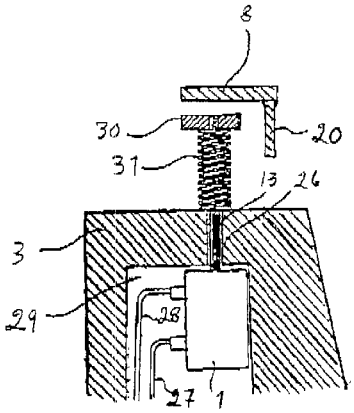
FIG. 4 illustrates a trigger for a triggering valve.

FIG. 4 illustrates a trigger for the triggering valve 1, mounted to the hub 3, between the hub 3 and the actuator ring 8.

The triggering mechanism functions as follows: An angular displacement $\alpha$ of the riser 2 causes an identical angular displacement $\alpha$ of the cam ring 5, and when the angular displacement $\alpha$ of the riser and the can ring 5 exceeds a predetermined, maximum acceptable angle, the cam ring 5 contacts the actuator ring 8 and forces the actuator ring 8 towards the hub 3, as illustrated in FIGS. 1 and 2. As discussed above, due to the hydraulic cylinders and the cross-connecting conduits, the actuator ring 8 thereby moves translatory towards the hub 3. The actuator ring 8 contacts and activates the trigger for the triggering valve 1, which causes an activating of the hydraulic emergency unlock circuit, which unlocks the hydraulically operated gripping members of the riser connector.

Due to the translatory movement of the actuator ring 8, the trigger for the triggering valve 1 will be activated irrespectively of its location along the circumference of the hub 3, or in other words, irrespectively of the direction of the angular displacement α of the riser 2.

FIG. 4 illustrates a preferred trigger, formed by a valve stem 13 of the triggering valve 1. The valve 1 is a standard hydraulic valve, and is included in the emergency unlock circuit by hydraulic tubing 27 and 28. In FIG. 4 the valve 1 is closed, i.e. there is no connection between tubing 27 and 28. If the valve stem 13 is depressed, the valve is opened, i.e. a connection between tubing 27 and 28 is established, and the emergency unlock circuit is activated.

The triggering valve 1 is located in a recess 29 in the hub 3, and the valve stem 13 is extending through and guided by a bore 26 in the hub 3. A valve stem plate 30 is attached on top of the valve stem 13, and a spring 31 is compressed between the hub 3 and the valve stem plate 30. The spring 31 thereby biases the valve stem 13 upwards, into the position illustrated in FIG. 4, in which the triggering valve 1 is closed. When the actuator ring 8 is moved downwards by the cam ring 5, as discussed above, the actuator ring 8 contacts the valve stern plate 30, and presses the valve stem plate 30 and the valve stem 13 down, which opens the valve 1, which opens an initialising flow in the emergency unlock circuit.

It is thereby provided a simple mechanical triggering mechanism which is independent of any external connections or signals, and which due to its simplicity is reliable.

FIGS. 1 and 2 illustrate an embodiment of the invention in which the triggering mechanism is realised by separate components mounted to the hub 3, Alternatively, the hydraulic cylinders 6, 6' may be formed by bores in the hub 3. Further the cross-connecting conduits 12, 12' may be formed by channels in the hub 3. In this way the mechanism will be integrated in the hub 3, and the mechanism will thereby be better protected from environmental hazards, e.g. falling objects FIG. 4 illustrates a trigger for the triggering valve which is essentially integrated in the hub 3, and which is thereby essentially protected from environmental hazards.

What is claimed is:

1. A triggering mechanism for a triggering valve (1) of a hydraulic emergency unlock circuit for unlocking hydraulically operated gripping members of a riser connector which connects a lower end of a riser (2) to a wellhead on a sea floor, angular displacement (α) of the riser (2) is allowed by a flex joint comprising a stationary part (3) connected to the riser connector by the gripping members and an angularly displaceable part (4) secured to the lower end of the riser (2), the stationary part (3) of the flex joint and the displaceable part (4) of the flex joint being coaxial when the riser (2) is in a non-displaced position, wherein the triggering mechanism comprises:

a cam ring (5) which is secured to and coaxial with the displaceable part (4) of the flex joint, hydraulic cylinders (6, 6') which are secured to the stationary part (3) of the flex joint and are parallel with an axis of the stationary part (3) of the flex joint, and which are arranged in a circle which is coaxial with the stationary part (3) of the flex joint, through-going piston rods (7, 7') of the hydraulic cylinders (6, 6'), an actuator ring (8) mechanically connected to ends of the piston rods (7, 7,') pointing towards the cam ring (5), the actuator ring (8) then being coaxial with the stationary part (3) of the flex joint, the actuator ring (8) is arranged with a clearance to the cam ring (5), the cam ring (5) and the actuator ring (8) then being parallel when the stationary part (3) of the flex joint and the displaceable part (4) of the flex joint are coaxial, pistons (9, 9') dividing the hydraulic cylinders (6, 6') in upper chambers (10, 10') and lower chambers (11, 11'), the upper chambers (10, 10') being on the actuator ring (8) side of the pistons (9, 9'), the through-going piston rods (7, 7') ensure equal cross-sectional area in the upper and lower chambers, cross-connecting conduits (12, 12') connecting upper chambers (10, 10') with lower chambers (11, 11') in oppositely located hydraulic cylinders (6, 6'), a trigger (13) for the triggering valve (1) located on the stationary part (3) of the flex joint, between the stationary part (3) of the flex joint and the actuator ring (8), whereby an angular displacement (α) of the riser (2) causes an angular displacement (α) of the cam ring (5), when the angular displacement (α) of the cam ring (5) exceeds a predetermined angle the cam ring (5) contacts the actuator ring (8) and forces the actuator ring (8) towards the stationary part (3) of the flex joint, causing movement of the piston rods (7, 7') and the pistons (9, 9'), causing hydraulic flow in the cross-connecting conduits (12, 12'), which ensure equal movement of pistons (9, 9') and piston rods (7, 7') in oppositely located hydraulic cylinders (6, 6'), the actuator ring (8) thereby move translatory, causing an activating of the trigger (13) for the triggering valve (1), irrespectively of the direction of the angular displacement (α) of the riser (2).

2. A triggering mechanism according to claim 1, wherein the trigger for the triggering valve (1) is formed by a valve stem (13) of the triggering valve (1), which valve stem when depressed by the actuator ring (8) opens an initialising flow in the emergency unlock circuit (28, 29).

3. A triggering mechanism according to claim 1, wherein the hydraulic cylinders (6, 6') are equally spaced along their circle, forming three pairs, each pair consisting of two oppositely located hydraulic cylinders.

4. A triggering mechanism according to claim 1, wherein the piston rods (7, 7') of the hydraulic cylinders (6, 6') are biased (23) towards the cam ring (5), thereby forcing the actuator ring (8) towards the cam ring (5).

5. A triggering mechanism according to claim 1, wherein the hydraulic cylinders (6, 6') are formed by bores of the stationary part (3) of the flex joint.

6. A triggering mechanism according to claim 1, wherein the cross-connecting conduits (12, 12') are formed by channels of the stationary (3) part of the flex joint.

7. A triggering mechanism according to claim 1 or 6, wherein the trigger for the triggering valve (1) is integrated in the stationary part (3) of the flex joint.

* * * * *